US006121934A

United States Patent [19]

Taniguchi et al.

[11] Patent Number: 6,121,934

[45] Date of Patent: Sep. 19, 2000

[54] GLASS ANTENNA DEVICE FOR VEHICLE

[75] Inventors: Tatsuaki Taniguchi; Kazuo Shigeta, both of Aki-gun; Hiroshi Iijima, Osaka, all of Japan

[73] Assignee: Nippon Sheet Glass Co., Ltd., Japan

[21] Appl. No.: 09/266,412

[22] Filed: Mar. 10, 1999

[30] Foreign Application Priority Data

Mar. 11, 1998 [JP] Japan ..... 10-059931
Nov. 16, 1998 [JP] Japan ..... 10-325318

[51] Int. Cl.[7] ..... H01Q 1/32

[52] U.S. Cl. ..... 343/713; 343/704

[58] Field of Search ..... 343/858, 711, 343/712, 713, 853, 704, 864; H01Q 1/32, 13/10

[56] References Cited

U.S. PATENT DOCUMENTS

| | | | |
|---|---|---|---|
| 4,749,998 | 6/1988 | Yotsuya | 343/713 |
| 5,185,612 | 2/1993 | Tsukada et al. | 343/713 |
| 5,313,217 | 5/1994 | Kakizawa | 343/713 |
| 5,457,467 | 10/1995 | Schenkyr et al. | 343/713 |
| 5,581,264 | 12/1996 | Tabata et al. | 343/713 |
| 5,883,599 | 3/1999 | Hall | 343/713 |
| 5,905,470 | 5/1999 | Fujii et al. | 343/713 |
| 5,940,042 | 8/1999 | Van Hoozen | 343/713 |

FOREIGN PATENT DOCUMENTS

| | | |
|---|---|---|
| 2-39702 | 2/1990 | Japan . |
| 6224611 | 8/1994 | Japan . |
| 6224612 | 8/1994 | Japan . |
| 6268422 | 9/1994 | Japan . |
| 7111412 | 4/1995 | Japan . |
| 8162826 | 6/1996 | Japan . |
| 9-18222 | 1/1997 | Japan . |
| 9107218 | 4/1997 | Japan . |

OTHER PUBLICATIONS

Patent Abstracts of Japan, vol. 1997, No. 02 Feb. 28, 1997.

*Primary Examiner*—Tho Phan
*Attorney, Agent, or Firm*—Adams & Wilks

[57] ABSTRACT

A glass antenna device for a vehicle includes an FM antenna (as a receiving antenna for short-waves) and a defogger provided on a rear window glass of the vehicle, and an AM antenna (as a receiving antenna for medium-waves) provided on a side window glass fixed at a different position from the rear window glass of the vehicle. Since the AM antenna is spaced relatively far distant from electric equipments such as a rear wiper, stop lamps and indicators disposed at a rear portion of the vehicle, noises generated from the electric equipments are unlikely to be mixed in a transmission line of the antenna device.

20 Claims, 9 Drawing Sheets

GLASS ANTENNA DEVICE FOR VEHICLE

BACKGROUND OF THE INVENTION

1. Field of the Invention

The present invention relates generally to a glass antenna device for use on vehicles having a rear window in a hinged rear hatch or a hatchback which is widely used in recreational vehicles, station wagons and so on. More particularly, this invention relates to a vehicle window glass antenna device having a first antenna arranged in a rear window glass for the reception of FM and TV broadcasts, and a second antenna arranged in a window glass of a fixed side window, such as an opera window or a quarter window, for the reception of AM broadcasts.

2. Description of the Related Art

Glass antenna devices including antenna strips provided, together with a plurality of defogging heater elements (forming a defogger), on a rear window glass of a vehicle for the reception of radio waves are known. In the known glass antenna devices, a choke coil is inserted in a power supply line to the heater elements so that the defogging heater elements can be utilized as a receiving antenna. Additionally, the configuration, arrangement and position of the antenna strips are adjusted so that radio waves in an AM broadcast band and an FM broadcast band (as well as a TV broadcast band when the need arises) can be received at a high sensitivity.

Some known vehicle window glass antenna devices for the reception of AM-FM broadcasts include a preamplifier provided between a feed terminal of the antenna strips and an input terminal of the radio set or receiver so as to improve the reception performance.

However, use of the preamplifier poses a problem in that waveform distortion or cross modulation distortion is likely to occur during reception in a strong electric field, and noise mixed in the glass antenna is amplified. To cope with this problem, various improvements have been proposed for the glass antenna devices to obtain a sufficient degree of reception sensitivity without any preamplifier.

One such proposed improvement is disclosed in Japanese Patent Laid-open Publication No. (HEI) 6-268422, which provides a glass antenna device having a loop-shaped main antenna strip and a feeding point provided on a vehicle rear window glass. Plural return strips extending toward the center of the main antenna strip are provided in the neighborhood of the both sides of the main antenna strip, with the top ends of the return strips used as open ends, so as to obtain a sufficient reception sensitivity in the FM broadcast band without using a preamplifier.

Japanese Patent Laid-open Publication No. (HEI) 7-111412 discloses another improved known vehicle glass antenna device which comprises a defogger composed of a plurality of defogging heater elements formed of electric conductors provided on a vehicle rear window glass, an antenna conductor arranged in a predetermined pattern in the neighborhood of the defogger so as to form a capacitive coupling together with the defogger, a reactance circuit inserted between the defogger and a DC power source, and a matching circuit inserted between a feeding point of the antenna conductor and a receiver. To receive a broadcast at a high sensitivity without using a preamplifier, an anti-resonance point is set to frequencies at the outside of the broadcast band by the stray capacitance of the defogger and the reactance circuit, and a resonance point is set between a minimum frequency of the broadcast band and a frequency being a multiple of 1.5 of a highest frequency of the broadcast band by the impedance of the matching circuit, the impedance of the receiver, and the impedance when viewing the antenna conductor from the matching circuit.

Still another improved vehicle glass antenna device known from Japanese Patent Laid-open Publication No. (HEI) 8-162826 includes plural heating conductor strips provided on a vehicle rear window glass in the horizontal direction, and plural antenna conductor strips arranged in the horizontal direction. An auxiliary strip is provided close to a conductor strip at the lowest part of the antenna between a lowest antenna strip and an uppermost heating conductor strip arranged in the horizontal direction. A coil or a coil and a capacitor are inserted between the auxiliary strip and the uppermost heating conductor strip. This arrangement can suppress a leakage current to the vehicle body during the reception of an AM or an FM broadcast wave, and also realizes optimum tuning without any restriction onto an antenna pattern for the reception of FM broadcast waves.

In a vehicle glass antenna device disclosed in Japanese Patent Laid-open Publication No. (HEI) 9-107218, a defogger, an antenna conductor for the AM frequency band, and an antenna conductor for the FM frequency band are provided on a vehicle rear window glass. The AM antenna conductor is capacitively coupled to the defogger. The AM antenna conductor and the FM antenna conductor are connected by a circuit component including the inductance component, and a low pass filter is inserted between the defogger and a DC power source. This arrangement can eliminate the need for a choke coil and improves the S/N ratio.

A vehicle glass antenna device proposed by the present assignee by way of Japanese Patent Laid-open Publication No. (HEI) 9-18222 includes an exclusive antenna and a compatible antenna (defogging heater conductor) formed on a window glass. A transformer has a primary winding connected at its one end to the exclusive antenna and at its middle point to the compatible antenna, and a secondary winding connected to a feeder cable to perform the impedance conversion. With this arrangement, a choke coil is no longer needed, the capacity of the feeder cable is reduced when viewed from the antennas, and the transmission loss is also reduced to such an extent that a practically sufficient reception sensitivity can be obtained.

Somewhat different vehicle glass antenna devices disclosed in, for example, Japanese Patent Laid-open Publications Nos. (HEI) 2-39702, 6-224611 and 6-224612 have an antenna strip for the reception of FM broadcast waves and another antenna strip for the reception of AM broadcast waves, both antenna strips being provided on a vehicle side window glass.

It appears clear from the foregoing description that for the reception of an AM broadcast at high sensitivity without use of a preamplifier, an AM broadcast receiving antenna formed on a vehicle rear window glass requires a choke coil or a low pass filter inserted in a feed path or line to a defogging heater or defogger which is used in combination with a matching circuit or an impedance conversion transformer inserted between an antenna strip and a feeding point, or with a circuit including an inductance component or a capacitor between the antenna strip and the defogger or between the antenna strip and an auxiliary strip. Thus, a space must be provided in the vicinity of the rear window glass or on a surface of the rear window glass for the installation of the circuit including the choke coil, inductance component, capacitor and so on.

However, some types of vehicles, due to the structure peculiar thereto, are sometimes unable to provide a sufficient space for installation of the circuit components. Particularly, most vehicles having a hinged rear hatch (hereinafter referred to, for brevity, as "hatchback vehicles") have an insufficient circuit-components installation space.

The hatchback vehicles further require the circuit to have circuit components and a packing structure which are strong enough to withstand shock or impact force produced when the hatchback is opened and closed. This requirement renders the packaging process uneasy to achieve and induces additional cost.

Furthermore, in the antenna formed on the rear window glass for the reception of AM broadcasts, noise generated by various electric equipment such as a rear wiper, rear lamps and indicators are likely to be mixed in, and an appropriate countermeasure to the noises is in many cases difficult to achieve.

In the case where an antenna conductor for the AM band and an antenna conductor for the FM band are provided on a vehicle rear window glass, separate adjustment of the reception characteristics of the respective antenna conductors is difficult to achieve. This problem may be overcome by arranging the FM antenna conductor in a vehicle side window glass rather than in the rear window glass. In this instance, there still remains a problem that noise generated by the electric equipment is mixed in the AM antenna arranged in the rear window glass.

SUMMARY OF THE INVENTION

It is accordingly an object of the present invention to provide a glass antenna device for a vehicle, which includes an antenna for the AM band (i.e., a medium-wave band receiving antenna) provided on a fixed side window glass of the vehicle so that interference with noise generated by electric equipment of the vehicle can be suppressed and also the need for various electric circuit components conventionally disposed on or in the vicinity of a vehicle rear window glass can be eliminated.

According to the present invention, there is provided a glass antenna device for use with window glasses of a vehicle, comprising: a defogging heater provided on a rear window glass of the vehicle for defogging the rear window glass; a first receiving antenna provided on the rear window glass for the reception of radio waves in a frequency range above a shortwave band; and a second receiving antenna provided on a fixed side window glass of the vehicle for the reception of radio waves at a medium wave band, the fixed side window glass being located at a different position from the rear window glass.

The first antenna provided on the rear window glass may include an FM antenna for the reception of FM broadcasts, and the second antenna provided on the fixed side window glass may be an AM antenna for the reception of AM broadcasts. The fixed side window glass may include a window panel of an opera window or of a fixed rear quarter window.

In the glass antenna device of the present invention, because the FM antenna (receiving antenna for shortwave band) and the AM antenna (receiving antenna for medium wave band) are provided on the rear window glass and the fixed side window glass, respectively, it becomes possible to hold the AM antenna relatively distant from a wire harness connected to electrical equipment, such as a rear wiper, rear lamps and indicators. This arrangement can suppress interference with noise generated by the electric equipment.

Since the AM antenna is provided on the fixed side window glass rather than the rear window glass, the rear window glass has enough room for installation of an FM exclusive antenna, an FM antenna for a frequency range above the shortwave band, a TV antenna, or an antenna for mobile operation. By virtue of a relatively large area provided in the rear window glass, antenna-pattern design work and adjustment of frequency response of the antenna can be achieved with ease. Additionally, since the defogging heater is not used as a part of the antenna, no choke coil is required.

In the case of a conventional glass antenna device having a defogger, an antenna for the FM broadcast band and an antenna for the AM broadcast band all provided on a rear window glass, an antenna component such as a matching circuit composed of a choke coil, an inductance component, a capacitor and so on must be provided in the vicinity of the rear window glass so as to obtain a sufficient reception level without use of a preamplifier. By contrast, according to the glass antenna device of the present invention, since the rear window glass is used exclusively for installation of an FM only antenna or an antenna other than an AM antenna, the antenna component disposed in the vicinity of the rear window glass is not needed any more.

In the glass antenna device of the present invention, a signal received at the AM antenna is transmitted through a transformer to a receiver. Use of the transformer insures the reception of AM signal with a high sensitivity even though the fixed side window glass, such as a window panel of an opera window or of a fixed rear quarter window, can provide only a small area available for installation of the AM antenna. In other words, the smaller the area of the fixed side window glass, the shorter the length of the AM antenna pattern. However, since transmitting the signal received at the AM antenna through the transformer to the receiver can compensate for a reduction in the reception sensitivity of the AM antenna, the AM antenna can receive AM broadcasts with a high sensitivity without any filter circuit to remove noise generated from the electric equipment.

In the glass antenna device of the present invention, a coaxial cable connected to the FM antenna is connected to the receiver via an AM signal leakage preventing capacitor. The AM signal received at the AM antenna is prevented from passing around into the FM antenna, so that the receiver can receive the FM reception signal with a high sensitivity.

The glass antenna device further includes an AM-antenna-side impedance converter connected to the FM antenna and the AM antenna through respective transmission lines for performing the impedance conversion of the transmission lines, and a receiver-side impedance converter electrically connected to the AM-antenna-side impedance converter, and a receiver connected by a cable to the receiver-side impedance converter. The cable has a distributed capacitance below 10 pF. With this arrangement, the glass antenna device can receive AM broadcasts with a high sensitivity with little attenuation of AM reception signals.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

Figure 1:
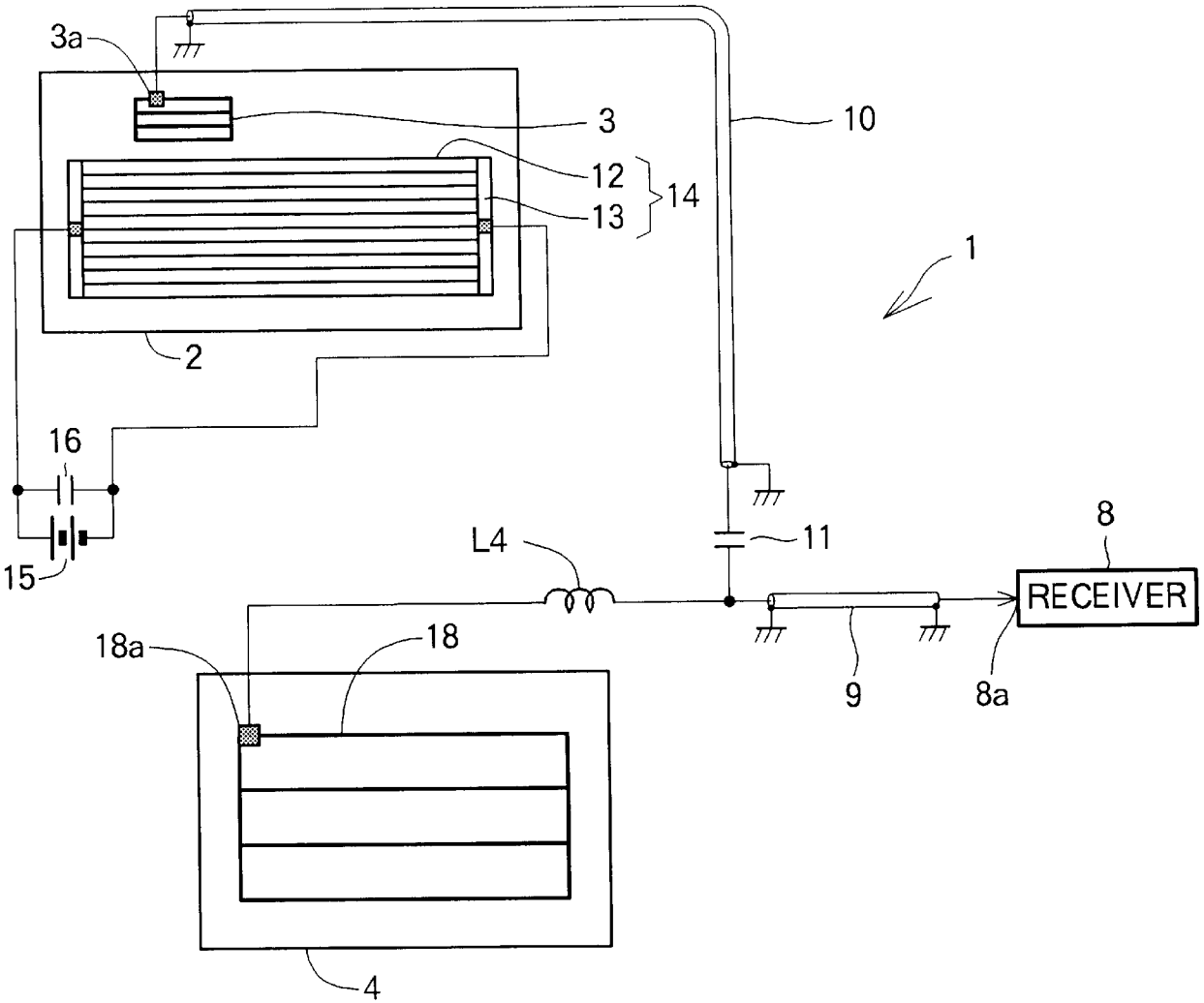
FIG. 1 is a diagrammatical view showing the general arrangement of a glass antenna device for a vehicle having a relatively large side window glass.

Referring now to FIG. 1, there is shown a glass antenna device 1 for a vehicle according to a first embodiment of the present invention. The glass antenna device 1 includes an AM antenna 18 having a relatively wide antenna pattern which enables the reception of AM broadcasts with a high sensitivity.

The vehicle glass antenna device 1 generally comprises an FM antenna 3 provided on a rear window glass 2 of the vehicle for the reception of radio waves in a frequency band above a short-wave band, an AM antenna 18 provided on a fixed window glass, such as a side window glass 4, at a different position from the rear window glass 2 for the reception of radio waves in a medium-wave band, a receiver 8, a coaxial cable 10 connected at one end to a feeding point 3*a* of the FM antenna 3, an FM antenna connection capacitor 11 connected at the other end of the coaxial cable 10 for connection of the FM antenna 3 to the receiver 8, a choke coil L4 connected between a feeding point 18*a* of the AM antenna 18 and the capacitor 11, and a similar coaxial cable 9 connected at one end to the junction between the capacitor 11 and the choke coil L4 and at the other end to the receiver 8.

The rear window glass 2 is provided with a defogger 14 composed of a plurality of defogging heater elements 12 and a pair of bus bars 13.

When a defogger switch (not shown) is turned on, an electric current from a battery power source 15 is supplied through the bus bars 13 to the heater elements 12. A capacitor 16 for absorbing high-frequency noise is connected in parallel with the battery power source 15 so that high-frequency noise, such as engine ignition noise, is prevented from being mixed into the defogger side.

The choke coil L4 connected to a pattern extending from the feeding point 18*a* of the AM antenna 18 and the receiver 8 are connected together by means of the coaxial cable 9. The choke coil L4 has an inductance of the order of 2 microhenry ($\mu$H) so as to prevent an FM signal from passing from the FM antenna 3 side into the AM antenna 18 side. The coaxial cable 9 used in the illustrated embodiment is a 1.5C2V coaxial cable stipulated by Japanese Industrial Standards (JIS), the coaxial cable being hereinafter referred to as JIS1.5C2V coaxial cable.

The choke coil L4 and the feeding point 3*a* of the FM antenna 3 are connected together through the coaxial cable 10 and the capacitor 11. The coaxial cable 10 is also a JIS 1.5C2V coaxial cable. The distance between the feeding point 3*a* of the FM antenna 3 and the choke coil L4 is set to be about 2 meters.

The choke coil L4 and a center conductor of the coaxial cable 10 are connected together via the capacitor 11. The capacitor 11 serves to prevent a reduction in sensitivity (a drop in the reception signal level in the AM broadcast band) which would otherwise occur due to the distributed capacitance of the coaxial cable 10. The capacitor 11 used in the illustrated embodiment has a capacitance of about 56 picofarad (pF).

A received signal in the FM broadcast band, which is received at the FM antenna 3 provided on the rear window glass 2, is supplied to an input terminal 8*a* of the receiver 8 successively through the feed point 3*a,* the coaxial cable 10, the capacitor 11 and the coaxial cable 9.

A reception signal at an AM broadcast band, which is received at the AM antenna 18 provided on the fixed side window glass 4, is supplied to the input terminal 8*a* of the receiver 8 successively through the feeding point 18*a,* the choke coil L4 and the coaxial cable 9.

Figure 2:
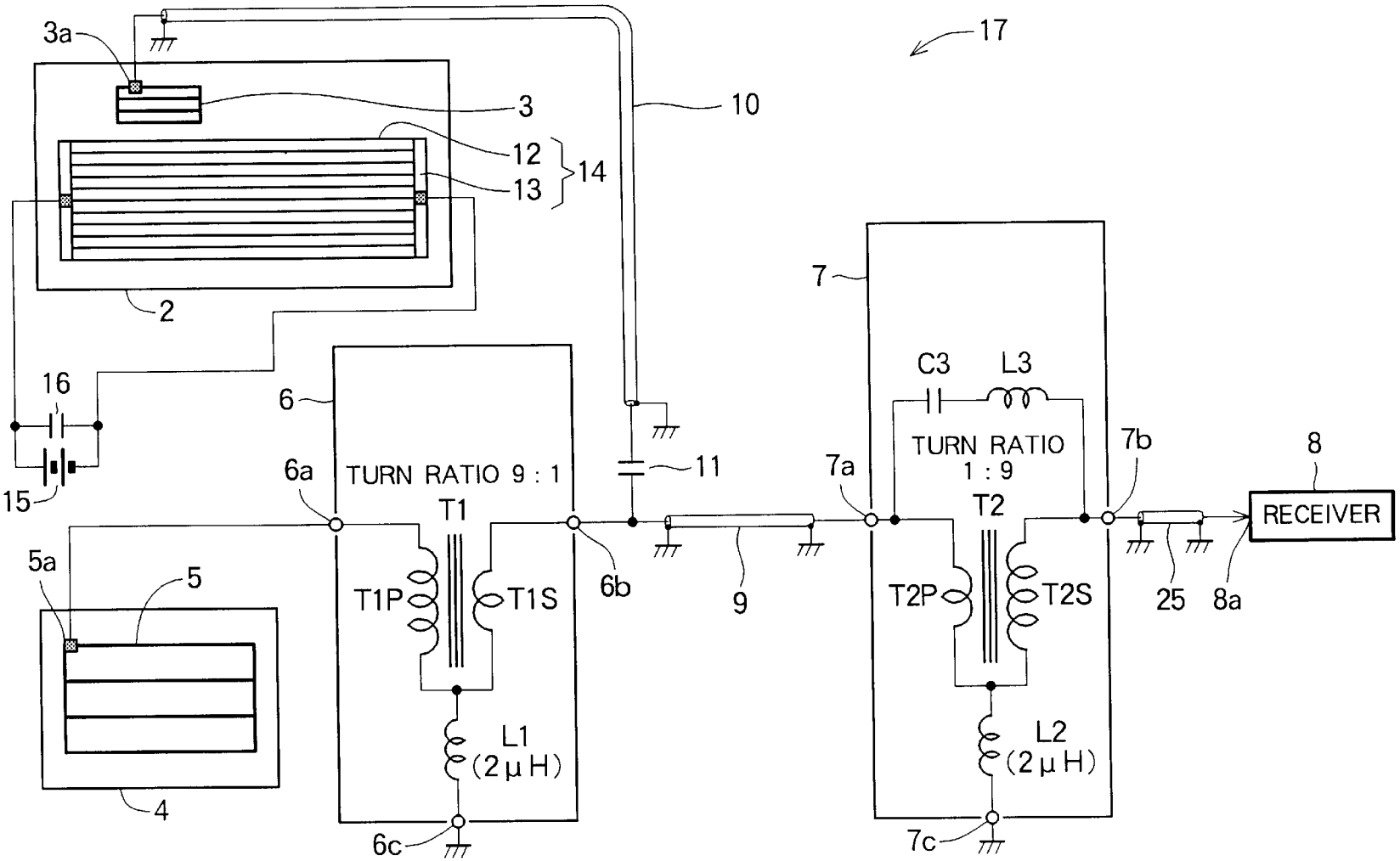
FIG. 2 is a view similar to FIG. 1, but showing a vehicle glass antenna device according to another embodiment in which the vehicle has a relatively small side window glass.

FIG. 2 shows a vehicle glass antenna device 17 according to a second embodiment of the present invention. This antenna device 17 is particularly suitable for an application where a fixed side window glass 4 is relatively small in size and, hence, high AM reception sensitivity is not expected due to a limited area available for arrangement of the antenna pattern of an AM antenna 5. The vehicle glass antenna device 17 differs from the vehicle glass antenna device 1 of the first embodiment shown in FIG. 1 in that it further includes a first impedance conversion circuit or converter (transformer) 6 provided between the feeding point 5*a* of the AM antenna 5 and a first coaxial cable 9, and a second impedance conversion circuit or converter (transformer) 7 provided between the coaxial cable 9 an the receiver 8. The first and second impedance converters 6 and 7 are hereinafter referred to as "AM-antenna-side impedance converter" and "receiver-side impedance converter", respectively.

The feeding point 5*a* of the AM antenna 5 is connected to an input terminal 6*a* of the AM-antenna-side impedance converter 6.

The AM-antenna-side impedance converter 6 includes a transformer T1 for transmitting reception signals at AM broadcast band, and a choke coil L1 that presents a high impedance to frequencies in the FM broadcast band to compensate for or offset a reduction in the FM reception sensitivity resulting from distributed capacitances of the transformer T1 and the second coaxial cable 10.

The transformer T1 used in the illustrated embodiment includes a primary winding T1P and a secondary winding T2S which are wound to provide a turn ratio of 9:1. The primary winding T1P has one end connected to an input terminal 6*a* of the AM-antenna-side impedance converter 6. One end of the secondary winding T1S is connected to an output terminal 6*b* of the AM-antenna-side impedance converter 6. The other end of the primary winding T1P and the other end of the secondary winding T1S are connected in common to a ground terminal 6*c* through the choke coil L1. The choke coil L1 used in the illustrated embodiment has an inductance of the order of 2 microhenry (2 $\mu$H). The ground terminal 6*c* is connected to, for example, a body earth of the vehicle.

A transformer T2 of the receiver-side impedance converter 7 is the same in construction as the transformer T1 of the AM-antenna-side impedance transformer 6, but the transformer T2 is connected in reverse to the transformer T1 such that the turn ratio of the transformer T2 (the ratio of the number of turns in a primary winding T2P to that in a secondary winding T2S) is 1:9.

The output terminal 6*b* of the AM-antenna-side impedance converter 6 (from which the reception signal from the AM antenna 5 is output) and the feeding point 3*a* of the FM antenna 3 are connected together by the second coaxial cable 10 and the FM antenna connection capacitor 11. Use of the second coaxial cable 10 enables the FM reception signal from the FM antenna 3 to be transmitted to the receiver 8 without attenuation. The second coaxial cable 10 used in the illustrated embodiment is a JIS 1.5C2V coaxial cable. The length of the coaxial cable 10 which extends between the feeding point 3*a* of the FM antenna 3 and the output terminal 6*b* of the AM-antenna-side impedance converter 6 is approximately 2 meters (2 m). The center conductor of the second coaxial cable 10 and the output terminal 6*b* of the AM-antenna-side impedance converter 6 are interconnected via the capacitor 11. The capacitor 11 serves to prevent desensitization (drop in AM reception signal level) which would otherwise occur due to the capacitance of the second coaxial cable 10. The capacitor 11 used in the illustrated embodiment has a capacitance of the order of 56 picofarad (56 pF)

The AM-antenna-side impedance converter 6 is disposed in the vicinity of the side window glass 4 on which the AM antenna is provided. The output terminal 6*b* of the AM-antenna-side impedance converter 6 and an input terminal 7*a* of the receiver-side impedance converter 7 are connected together by the first coaxial cable 9. The first coaxial cable 9 used in the illustrated embodiment has a length of about 4 m.

A reception signal in the AM broadcast band received by the AM antenna 5 on the side window glass 4 is supplied to an input terminal 8*a* of the receiver 8 successively through the transformer T1, the first coaxial cable 9, the transformer T2 and a third coaxial cable 25.

In the vehicle glass antenna devices 1, 17 shown in FIGS. 1 and 2, the AM antennas 18, 5 for the reception of AM broadcasts are provided on a fixed side window glass, such as a window panel of an opera window or a quarter window. Accordingly, the AM antennas 18, 5 are located relatively distant from vehicle electrical equipment including a rear wiper, stop lamps and indicators, as well as a wire harness extending to the electrical equipment.

In the embodiment shown in FIG. 1, due to the relatively large area of the fixed window glass 4, the AM antenna 18 is able to receive signals with a high sensitivity using the AM antenna pattern only. In the embodiment shown in FIG. 2, the fixed window glass has a relatively small area available for installation of the AM antenna 5. However, the AM-antenna-side impedance converter 6 associated with the AM antenna 5 enables highly sensitive reception of AM broadcast signals.

Figure 3:
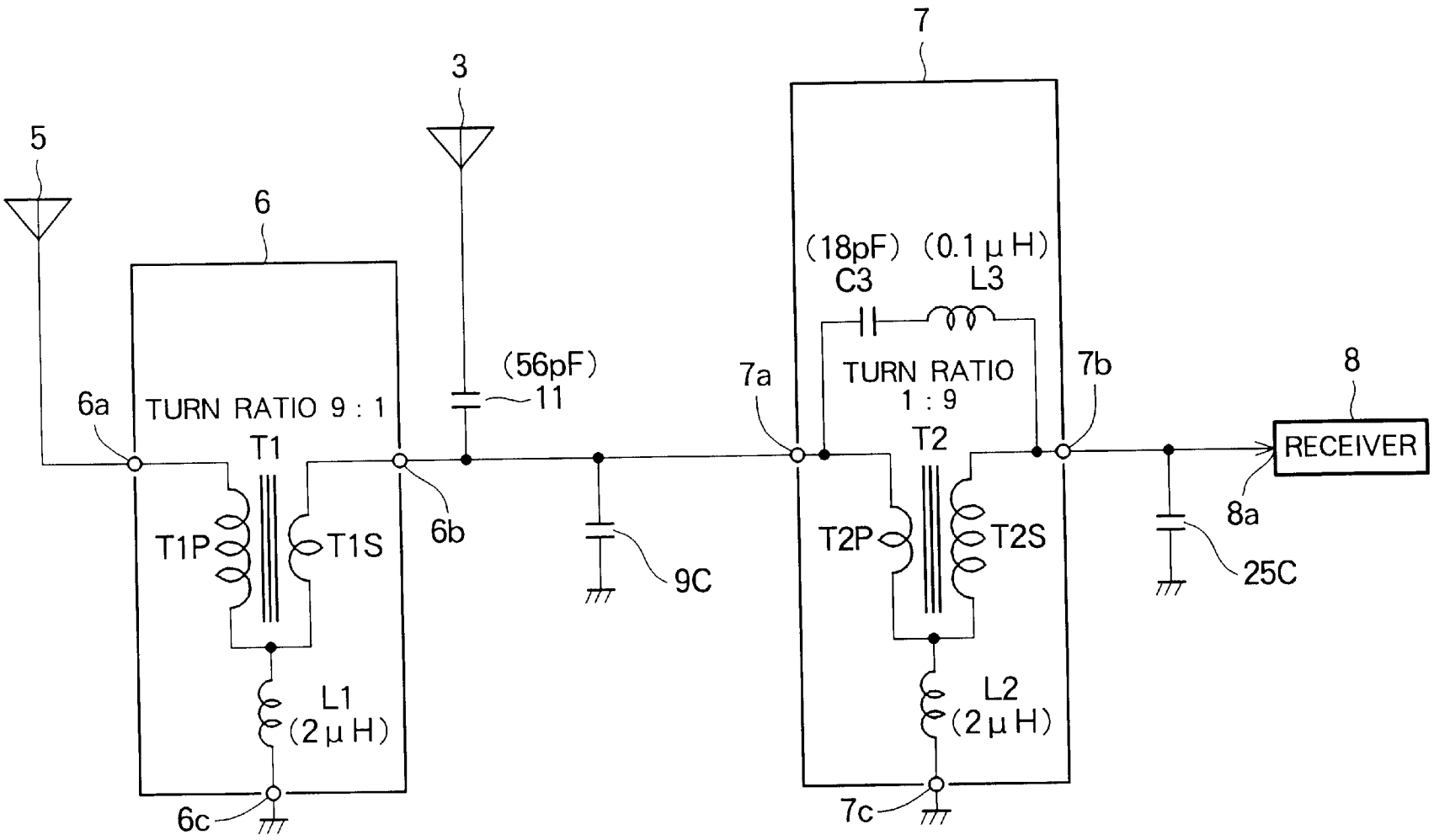
FIG. 3 is a circuit diagram showing an equivalent circuit of the AM stage of the glass antenna device shown in FIG. 2.

FIG. 3 shows an equivalent circuit of an AM stage of the vehicle glass antenna device 17 shown in FIG. 2.

In FIG. 3, reference character 9C denotes a distributed capacitance of the first coaxial cable (FIG. 2) interconnecting the AM-antenna-side impedance converter 6 and the receiver-side impedance converter 7. In the case of the first coaxial cable 9 consisting of a JIS 1.5C2V coaxial cable, its distributed capacitance is 70 pF per unit meter. Giving that the length of the first coaxial cable 9 is 4 m, the distributed capacitance of the 4-m-length first coaxial cable 9 should be 280 pF (70 pF/m×4 m).

When reception signals in the AM band received at the AM antenna 5 are transmitted to the receiver 8, the transformer T1 reduces the impedance at the first coaxial cable 9 side, and thereafter the transformer T2 increases the impedance so that the transmission loss at a transmission line is reduced.

In FIG. 3, denoted by 25C is a distributed capacitance of the third coaxial cable 25 (FIG. 2) extending between the receiver-side impedance converter 7 and the receiver 8. The AM reception sensitivity decreases with an increase in the distributed capacitance 25C.

In the case of the third coaxial cable 25 consisting of a JIS 1.5C2V coaxial cable, the length of this coaxial cable 25 should preferably be below 15 cm (approximately corresponding to the distributed capacitance of 10 pF) so that a reduction in the AM reception sensitivity can be maintained within −6 dB, as evidenced from the graph shown in FIG. 7. A sensitivity reduction not exceeding −6 dB is allowable because it does not hinder clear reception of signals in the AM broadcast band with no preamplifier used. An excessively long third coaxial cable 25 will cause undue reduction in the AM reception sensitivity due to its correspondingly increasing distributed capacitance even though the transformers T1 and T2 undertake impedance matching of the AM broadcast signal to avoid desensitization.

Figure 4:
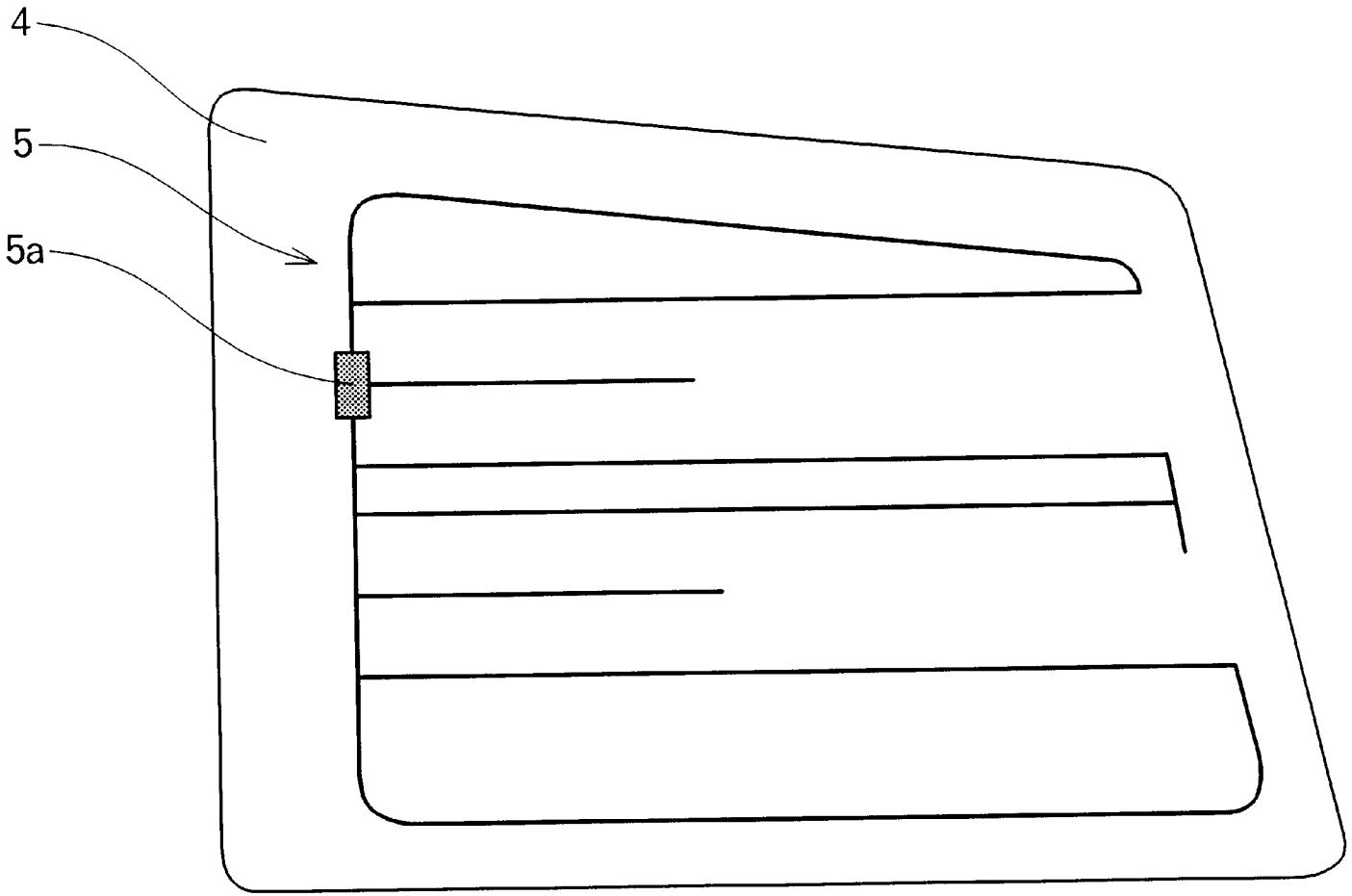
FIG. 4 is a diagrammatical view showing the pattern of an AM antenna arranged in a vehicle side window glass.

FIG. 4 diagrammatically shows an antenna pattern of the AM antenna 5 when viewed from the room interior of the vehicle. As shown in this figure, the antenna pattern of the AM antenna 5 is arranged substantially over the entire area of the fixed side window glass 4 to provide high sensitivity for the reception of AM broadcast signals.

Figure 5:
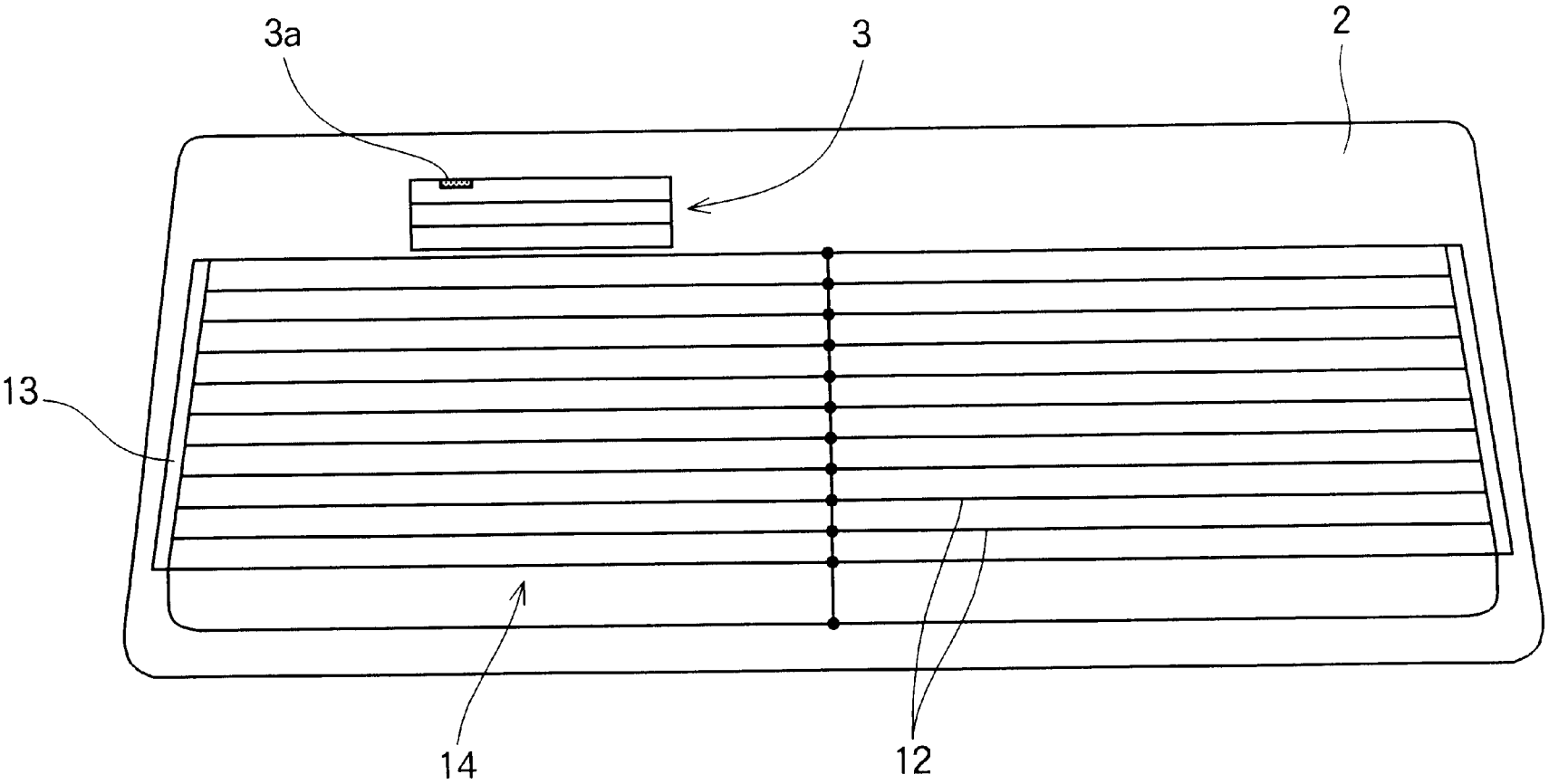
FIG. 5 is a diagrammatical view showing the pattern of an FM antenna and a defogging heater element arranged in a vehicle rear window glass.

FIG. 5 diagrammatically shows an antenna pattern of the FM antenna 3 when viewed from the room interior of the vehicle. As shown in this figure, the FM antenna 3 is located above the defogger 14 (including the defogging heater elements 12) arranged in the rear window glass 2. The FM antenna 3 is offset from a vertical center line of the rear window glass 2 but positioned close to the defogger 14.

The reception sensitivity of a inventive transmission system and the reception sensitivity of a conventional transmission system with respect to frequencies of signal received at the AM antenna are shown in Table 1 below.

TABLE 1

Sensitivity at AM band (unit: dB)

| Transmission System | Frequency (kHz) 666 | 1035 | 1458 |
|---|---|---|---|
| Inventive Transmission System with Impedance-matching Transformers | −3.3 | −2.0 | −1.4 |
| Conventional Transmission System with Low Capacitance Cable | −13.4 | −12.8 | −11.2 |

The inventive transmission system is constructed by the glass antenna device shown in FIGS. 2 and 3 and the AM antenna 5 shown in FIG. 4, wherein reception signal received at the AM antenna 4 are transmitted through the impedance converters 6, 7 to the receiver 8 (this transmission system is hereinafter referred to as "Transformer Transmission System"). As shown in Table 1, the reception sensitivities at respective measured frequencies are −3.3 dB at 666 kHz, −2.0 dB at 1035 kHz and −1.4 dB at 1458 kHz. The reception sensitivities thus obtained are sufficient for practical use of the glass antenna device.

In the conventional transmission system, reception signal received at the AM antenna 5 shown in FIG. 4 are transmitted to the receiver 8 through a conventional low capacitance cable (capacitance=30 pF/m, length=4 m) without using the impedance converters 6, 7 (this transmission system is hereinafter referred to as "Low-capacitance Cable Transmission System"). The reception sensitivities of the low-capacitance cable transmission system at respective measured frequencies are −13.4 dB at 666 kHz, −12.8 dB at 1035 kHz and −11.2 dB at 1458 kHz.

It appears clear from Table 1 that use of the transformer transmission system according to the present invention increases the reception sensitivity by about 10 dB as compared to the conventional low-capacitance cable transmission.

The sensitivities shown in Table 1 are values as compared to the sensitivity of a 900-mm-length reference antenna attached to a fender of the vehicle. Stated in other words, the sensitivities shown in Table 1 are indicated in terms of the ratio of the receiver's input level of the reference antenna to the receiver's input level of the inventive transformer transmission system or of the conventional low-capacitance cable transmission system.

Figure 6:
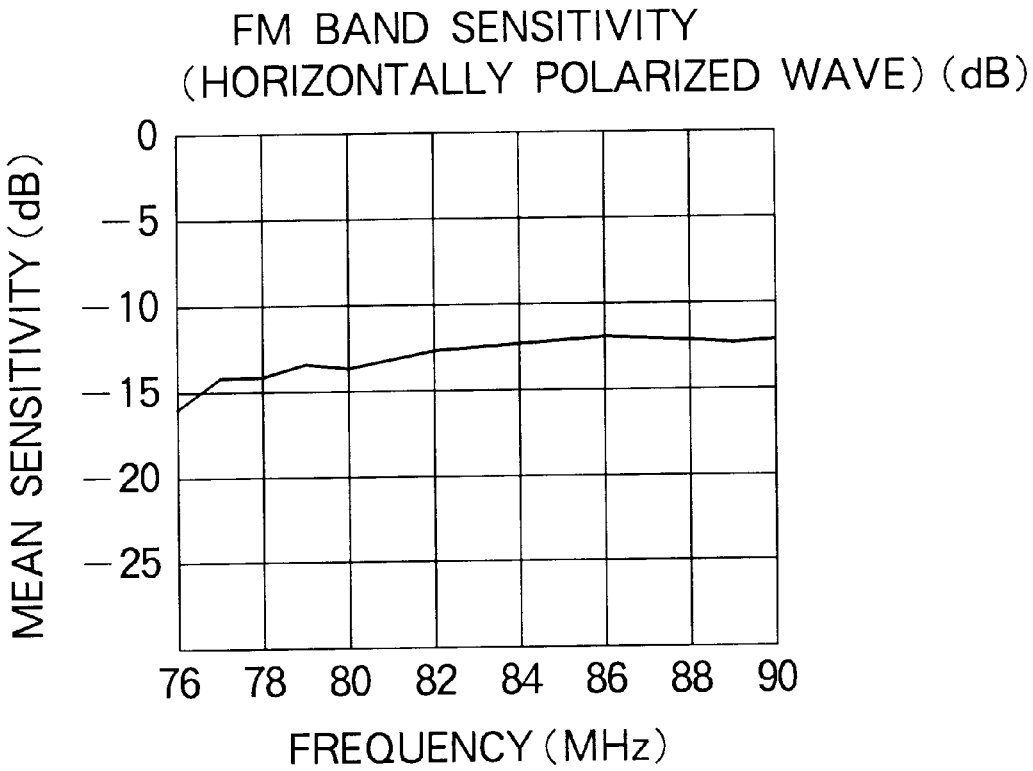
FIG. 6 is a graph showing the frequency response of the FM band sensitivity of the glass antenna device.

FIG. 6 is a graphical representation of the FM band sensitivity plotted at frequencies using a horizontally polarized wave. The sensitivity shown in FIG. 6 is indicated in terms of the ratio of the receiver's input level of a antenna device using a dipole antenna as a reference antenna to the receiver's input level of a antenna device including the FM antenna 3 shown in FIG. 5.

As evidenced from the graph shown in FIG. 6, the average FM band sensitivity of the inventive antenna device using the FM antenna 3 of FIG. 5 is −12.8 dB which is sufficient for practical use.

In the embodiment described above, the FM antenna 3 is provided on the vehicle rear window glass 2. The FM antenna may be arranged in the vehicle rear window glass 2 together with a TV antenna (not shown). Additionally, an antenna for mobile operation may be provided on the rear window glass 2. Furthermore, an antenna for shortwave broadcast band may be provided on the rear window glass.

Figure 7:
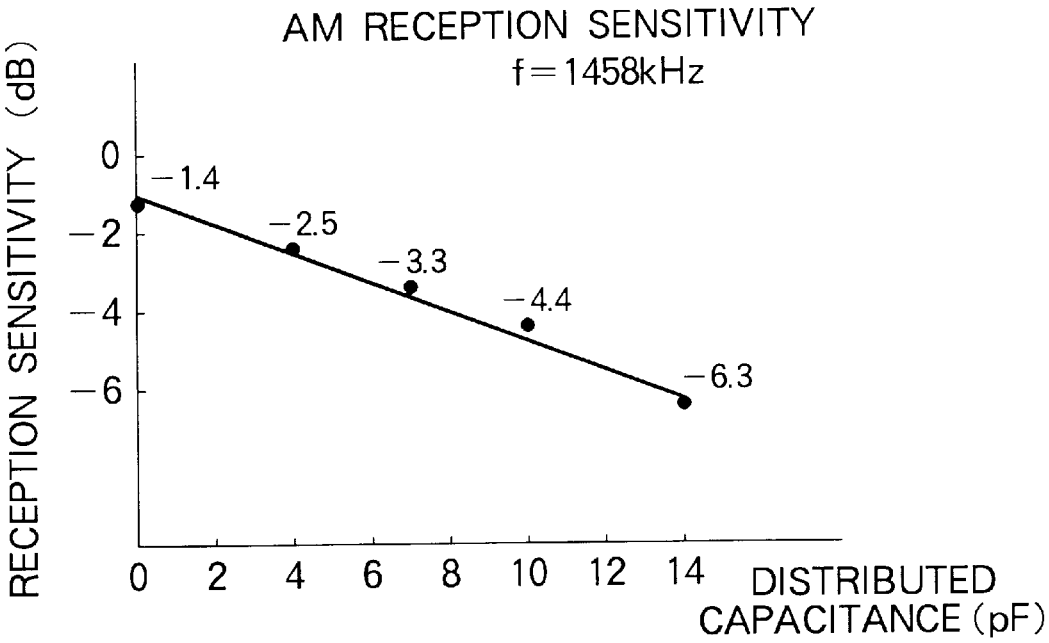
FIG. 7 is a graph showing the relationship between the AM reception sensitivity and the distributed capacitance of a third coaxial cable.

FIG. 7 is a graph showing the AM reception sensitivity versus distributed capacitance characteristics of the antenna device measured at a frequency of 1458 kHz.

As evidenced from FIG. 7, the AM reception sensitivity increases with a reduction of the distributed capacitance, and in order to maintain the reception sensitivity within −6 dB, the distribution capacitance shown be below 10 pF.

The AM reception sensitivity shown in FIG. 7 is indicated in terms of values as compared to the sensitivity of a 900-mm-length reference antenna attached to a fender of the vehicle. Stated in other words, the sensitivity shown in FIG. 7 is indicated by way of the ratio of the receiver's input level of the reference antenna to the receiver's input level of the inventive antenna device.

Figure 8:
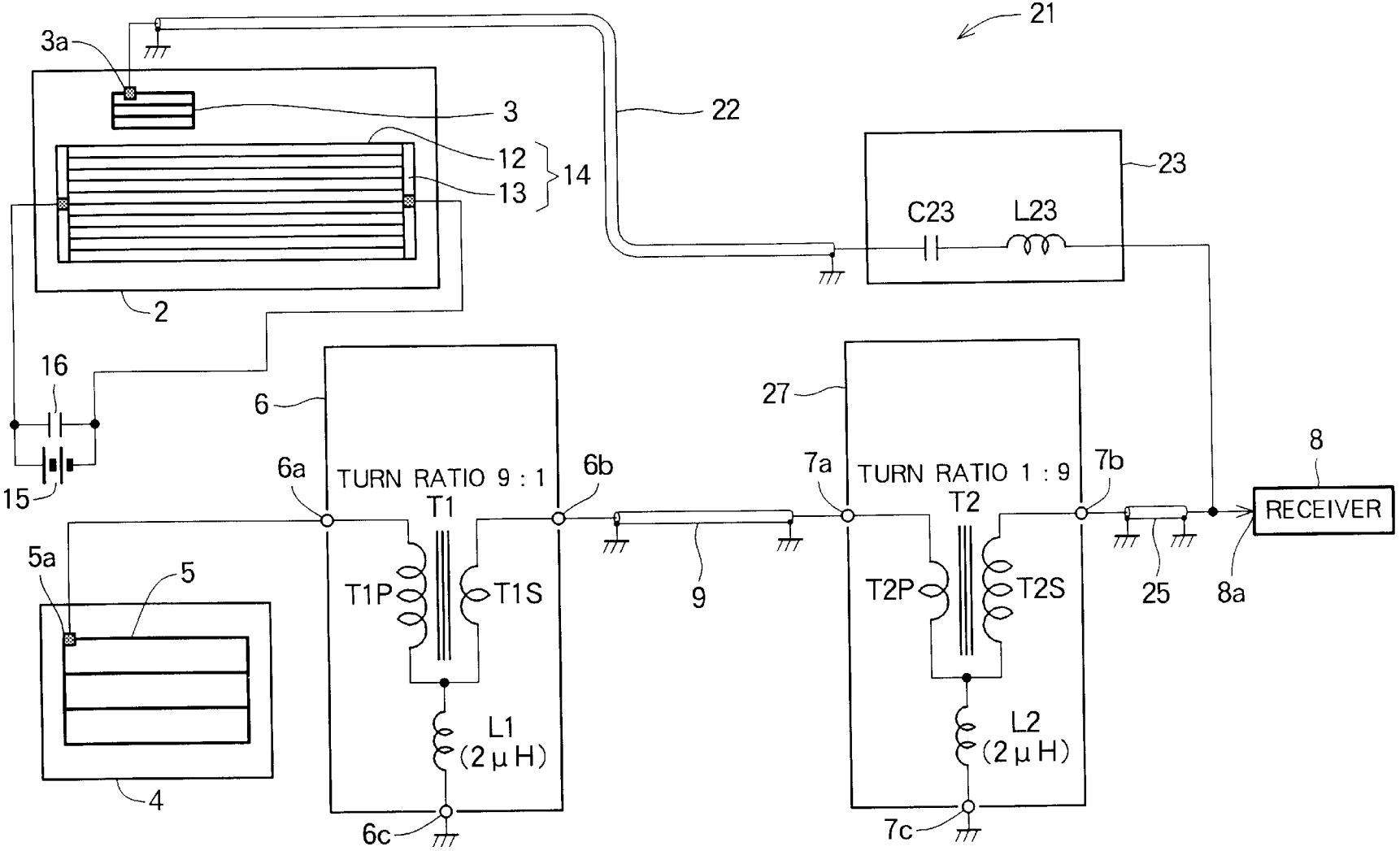
FIG. 8 is a diagrammatical view showing the general arrangement of a vehicle glass antenna device according to still another embodiment in which two coaxial cables are used exclusively for an FM antenna and an AM antenna, respectively.

FIG. 8 shows a vehicle glass antenna device 21 according to another embodiment of the present invention.

The antenna device 21 shown in FIG. 8 is featured in that a first coaxial cable 9 for transmission of AM broadcast reception signals and a second coaxial cable 22 for transmission of FM broadcast reception signals are provided separately.

The reception signals in the FM band received at an FM antenna 3 are transmitted through the second coaxial cable 22 (JIS 1.5C2V coaxial cable) to the proximity of a receiver 8, then supplied through an FM-pass and AM leakage prevention circuit 23 to an input terminal (antenna connecting terminal) 8*a* of the receiver 8. The FM-pass and AM leakage prevention circuit 23 shown in the illustrated embodiment is comprised of a capacitor C23 and a choke coil L23 connected in series with each other. As an alternative, this circuit 23 may be comprised of the capacitor 23 only.

A receiver-side impedance conversion circuit or converter 27 is composed of a transformer T2 and a choke coil L2.

A third coaxial cable 25 interconnects an output terminal 7*b* of the receiver-side impedance converter 27 and the input terminal 8*a* of the receiver 8.

Figure 9:
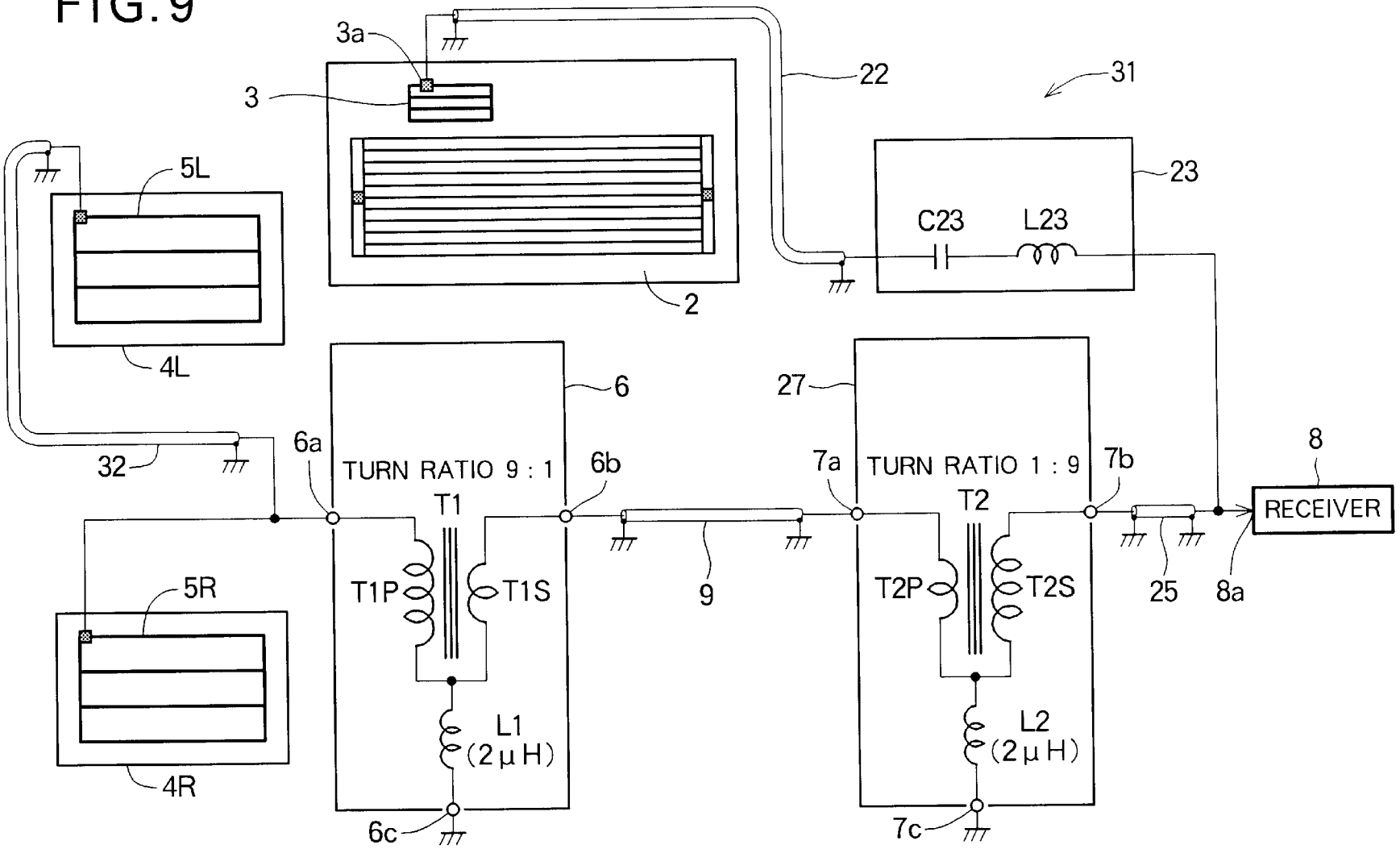
FIG. 9 is a diagrammatical view showing the general arrangement of a vehicle glass antenna device according to yet another embodiment in which an AM antenna is arranged in right and left side window glasses.

FIG. 9 shows a vehicle glass antenna device according to still another embodiment of the present invention.

The antenna device 31 shown in FIG. 9 differs from the antenna devices of the foregoing embodiments in that two AM antennas 5R and 5L are provided on a vehicle right side fixed window glass 4R and a vehicle left side fixed window glass 4L so as to further improve the AM reception sensitivity.

An AM-antenna-side impedance conversion circuit or converter 6 is disposed adjacent to one of the right and left side fixed window glasses 4R and 4L. The AM antenna provided on the other side fixed window glass and an input terminal 6*a* of the AM-antenna-side impedance converter 6 are connected together by a low-capacitance coaxial cable 32 which is used to reduce attenuation of the reception signal (received at the AM antenna 5L shown in FIG. 9).

Obviously, various minor changes and modifications are possible in the light of the above teaching. It is therefore to be understood that within the scope of the appended claims the present invention may be practiced otherwise than as specifically described.

What is claimed is:

1. A glass antenna device for use with window glasses of a vehicle, comprising:

a defogging heater provided on a rear window glass of the vehicle for defogging the rear window glass;

a first receiving antenna provided on the rear window glass separate from the defogging heater for the reception of radio waves in a frequency range above a shortwave band; and a second receiving antenna provided on a fixed side window glass of the vehicle for the reception of radio waves at a medium wave band, the fixed side window glass being located at a different position from the rear window glass;

wherein mounting of the second receiving antenna for the reception of medium wave band waves on the fixed side window glass eliminates the need for mounting of electronic circuit components on or in the vicinity of the rear window glass to obtain sufficient reception of signals in the medium wave band.

2. A glass antenna device according to claim 1; wherein the first antenna provided on the rear window glass is an FM antenna for the reception of FM broadcasts, and the second antenna provided on the fixed side window glass is an AM antenna for the reception of AM broadcasts.

3. A glass antenna device according to claim 2; wherein a signal received at the AM antenna is transmitted through transformers to a receiver.

4. A glass antenna device according to claim 2; wherein the FM antenna is electrically connected by a coaxial cable to a receiver with an AM signal leakage preventing capacitor inserted between the coaxial cable and the receiver.

5. A glass antenna device according to claim 2; further comprising an AM-antenna-side impedance converter connected to the FM antenna and the AM antenna through respective transmission lines for performing impedance conversion of the transmission lines, a receiver-side impedance converter electrically connected to the AM-antenna-side impedance converter, and a receiver connected by a cable to the receiver-side impedance converter; wherein the cable has a distributed capacitance below 10 pF.

6. A glass antenna device according to claim 1; wherein a signal received at the second antenna is transmitted through transformers to a receiver.

7. An antenna system for a hatchback vehicle, comprising: a first receiving antenna provided on a movable rear windshield of the hatchback vehicle for receiving FM signals; and a second receiving antenna provided on a window of the vehicle other than the rear windshield for receiving AM signals; wherein no electronic circuit components for impedance matching or filtering are mounted to or in the vicinity of the movable rear windshield.

8. An antenna system for a hatchback vehicle according to claim 7; further comprising a defogging heater provided on the movable rear windshield of the vehicle separate from the first receiving antenna.

9. An antenna system for a hatchback vehicle according to claim 7; wherein the first receiving antenna mounted to the movable rear windshield glass further receives signals outside of the FM band but not in the AM band.

10. An antenna system for a hatchback vehicle according to claim 7; wherein AM signals received at the second antenna are transmitted through transformers to a receiver.

11. An antenna system for a hatchback vehicle according to claim 7; wherein the first receiving antenna for receiving FM signals is electrically connected by a coaxial cable to a receiver with an AM signal leakage preventing capacitor inserted between the coaxial cable and the receiver.

12. An antenna system for a hatchback vehicle according to claim 7; further comprising an AM-antenna-side impedance converter connected to the FM antenna and the AM antenna through respective transmission lines for performing impedance conversion of the transmission lines, a receiver-side impedance converter electrically connected to the AM-antenna-side impedance converter, and a receiver connected by a cable to the receiver-side impedance converter.

13. An antenna system for a hatchback vehicle according to claim 12; wherein the cable has a distributed capacitance below 10 pF.

14. A glass antenna device for use with window glasses of a vehicle, comprising:

a defogging heater provided on a rear window glass of the vehicle for defogging the rear window glass;

a first receiving antenna provided on the rear window glass separate from the defogging heater for the reception of radio waves in a frequency range above a shortwave band; and a second receiving antenna provided on a fixed side window glass of the vehicle for the reception of radio waves at a medium wave band, the fixed side window glass being located at a different position from the rear window glass;

wherein a signal received at the second antenna is transmitted through transformers to a receiver.

15. A glass antenna device according to claim 14; wherein the first antenna provided on the rear window glass is an FM antenna for the reception of FM broadcasts, and the second antenna provided on the fixed side window glass is an AM antenna for the reception of AM broadcasts.

16. A glass antenna device according to claim 15; wherein the FM antenna is electrically connected by a coaxial cable to the receiver with an AM signal leakage preventing capacitor inserted between the coaxial cable and the receiver.

17. A glass antenna device according to claim 15; further comprising an AM-antenna-side impedance converter connected to the FM antenna and the AM antenna through respective transmission lines for performing impedance conversion of the transmission lines, a receiver-side impedance converter electrically connected to the AM-antenna-side impedance converter, and the receiver is connected by a cable to the receiver-side impedance converter.

18. A glass antenna device according to claim 17; wherein the cable has a distributed capacitance below 10 pF.

19. A glass antenna device according to claim 14; wherein the second antenna is an AM antenna for the reception of AM broadcasts; and the signal received at the AM antenna is transmitted through transformers to the receiver.

20. A glass antenna device according to claim 14; wherein mounting of the second receiving antenna for the reception of medium wave band waves on the fixed side window glass eliminates the need for mounting of electronic circuit components on or in the vicinity of the rear window glass to obtain sufficient reception of signals in the medium wave band.

* * * * *